US006516735B2

(12) United States Patent
Hintzen et al.

(10) Patent No.: US 6,516,735 B2
(45) Date of Patent: Feb. 11, 2003

(54) THREAD CUTTER

(75) Inventors: Peter Hintzen, Krickenbach (DE); Rolf Kessler, Karlsruhe (DE)

(73) Assignee: VSM Group Aktiebolag, Huskvarna (SE)

( * ) Notice: Subject to any disclaimer, the term of this patent is extended or adjusted under 35 U.S.C. 154(b) by 0 days.

(21) Appl. No.: 09/992,153

(22) Filed: Nov. 6, 2001

(65) Prior Publication Data

US 2002/0069802 A1 Jun. 13, 2002

(30) Foreign Application Priority Data

Nov. 8, 2000 (DE) ..... 100 55 258

(51) Int. Cl.[7] ..... D05B 65/00
(52) U.S. Cl. ..... 112/298
(58) Field of Search ..... 112/298, 296, 112/297, 291, 285, 289, 294, 299, 302, 301

(56) References Cited

U.S. PATENT DOCUMENTS 3,443,540 A 5/1969 Hannemann et al.
3,728,978 A * 4/1973 Honda et al. ..... 112/292
3,935,827 A * 2/1976 Winter ..... 112/292
4,455,957 A * 6/1984 Vollmar ..... 112/292
4,589,362 A * 5/1986 Dusch ..... 112/292
5,009,177 A * 4/1991 Sato et al. ..... 112/285

* cited by examiner

*Primary Examiner*—Ismael Izaguirre
(74) *Attorney, Agent, or Firm*—Pearne & Gordon LLP

(57) ABSTRACT

A thread cutter for use in a sewing machine with a rotating hook (12) has a surface cam (60) which, together with a cam follower (58), controls the movement path of a pivotable thread catcher lever (26), which grasps the thread with a thread catcher (30, 36) and severs it at a cutter (82). With known solutions the surface cam is seated on the main shaft of the machine, which results in space-consuming structures with a large amount of parts. It is therefore proposed to connect the surface cam (60) in a torsion-proof manner with the hook (12) and to provide arresting means (38) which, only during a revolution of the hook (12) with the needle raised, maintain the thread catcher lever (26) radially outside the engagement range of the surface cam (60) and only with definite triggering release the thread catcher lever (26) with a cam follower (58) for contact with the surface cam (60). The thread cutter therefore has only very few parts and can be housed without problems in the free arm of a sewing machine in a space-saving manner. Preassembly and pre-setting of the thread cutter, which constitutes one unit with the hook, is also possible.

17 Claims, 3 Drawing Sheets

THREAD CUTTER

FIELD OF THE INVENTION

The invention relates to a thread cutter for a sewing machine with a rotating hook, wherein a surface cam is provided which, together with a cam follower, controls the movement path of a pivotable thread catcher lever, which grasps the thread with a thread catcher and severs it with a cutter.

BACKGROUND OF THE INVENTION

A thread cutter of the type described above is known from DE 23 38 473 C2. However, with the thread cutter described there, two cams arranged on the main shaft of the sewing machine are provided which actuate the thread catcher lever and a separate thread draw-off finger at different times during the rotation of the hook. A large number of mechanical parts and a considerable requirement for installation space result from this, so that difficulties can arise in the course of housing the trigger and drive of the thread cutter in the front free arm of a machine. The adjustment of the sewing machine is also elaborate, because the rotating hook and the two cams on the main shaft must be separately set in respect to the angle of rotation position after the final assembly of the machine.

A further thread cutter for a post-bed sewing machine is known from U.S. Pt. No. 4,138,958, wherein a pin, which puts the thread cutter into motion in a translatory manner, is moved in the axial direction in a control cam of the hook shaft. The construction is the result of the structural uniqueness of a post-bed sewing machine, so that the thread cutter described in this publication cannot be structurally transferred to the shape customary with household sewing machines.

OBJECT AND SUMMARY OF THE INVENTION

It is the object of the present invention to provide a thread cutter for a sewing machine, which can be housed in a particularly space-saving manner in the front free arm.

In accordance with the invention, this object is attained in that the surface cam is connected in a torsion-proof manner with the hook and that arresting means are provided which, in their blocking position, maintain the cam follower which is coupled with the thread catcher lever radially outside the engagement range of the surface cam and, with manual or program-controlled triggering, only release the cam follower for contact with the surface cam during one revolution of the hook, during which the needle is outside of the pivot range of the thread catcher.

The main advantage of the thread cutter in accordance with the invention lies in that it consists of only a few mechanical parts, which can be housed without problems in the front free arm of a sewing machine. It is also advantageous that a pre-setting of the unit is possible because of a preferred arrangement of the surface cam on the hook shaft, so that a subsequent adjustment of the thread cutter after the sewing machine has been assembled is no longer required.

Further preferred measures, which aid in a further reduction of the requirement for structural space, are the placement of the cam follower directly on the thread catcher lever and/or the placement of the surface cam axially directly next to the hook, preferably on the back of the hook body.

It is furthermore particularly preferred to seat the thread catcher lever pivotably on the hook frame, because in that case the whole unit of hook and thread cutter can be pre-assembled and set.

In a preferred further embodiment of the invention the arresting means have a movable detent element, which in the blocking position maintains the thread catcher lever, which is pre-biased by a spring in the direction of pivoting-in, in a radial outer position in which the cam and the cam follower are out of engagement, wherein it is particularly preferred to disengage the detent element against the force of a restoring spring with the aid of an electromagnet, so that the cam follower of the thread catcher lever comes to rest against the surface cam because of the force of the spring. Besides the compact construction of such a solution, the simple control of the arresting means with the aid of the electromagnet should be stressed. The spring-loaded restoring spring offers the advantage that an automatic detent, and therefore blocking of the detent element, is possible by means of the appropriate pivoting of the thread catcher lever to the outside, wherein in a further preferred embodiment of the invention the control cam of the surface cam has a short cam section, which has the greatest radius of the control cam and with the aid of which the thread catcher lever can be conveyed into the blocking position in which it is locked together with the detent element.

To prevent a collision of the thread catcher lever it is important, because of the hook which revolves twice per needle lift, to permit pivoting-in of the thread catcher lever only when the needle is not in the pivot range of the thread catcher. For example, this can be achieved already in that the arresting means can only be unblocked at defined times and manual triggering is performed for example with a time delay until the needle has left the engagement range.

It is advantageous to provide an additional mechanical safety in that the arresting means preferably have an additional bolt which arrests the thread catcher lever in the radially outward position during the revolution of the hook shaft during which the needle is in the engagement range of the thread catcher lever. Erroneous triggering is dependably prevented by the additional bolt, wherein preferably the additional bolt is coupled with a cam follower, which acts together with a cam which essentially extends over 180 degree on the main shaft in the base of the sewing machine. Such a mechanical solution makes a pivoting-in movement of the thread catcher lever impossible and offers additional operational dependability in respect to an additional bolt, for example operated electromagnetically.

With a winding shaft which extends vertically in respect to the main shaft, in a further preferred embodiment the cam provided on the main shaft is designed as an axial cam, and the cam follower is coupled with a toothed rack as the additional bolt which is in contact with teeth around a pivot shaft of the thread catcher lever. Thus, only a linear guide with only one movable, possibly multi-part element, for the additional bolt is required, so that the additional mechanical safety can be provided simply and in a space-saving manner. With this solution the return of the additional bolt takes place interlockingly by means of the return movement of the thread catcher lever into its locked position.

A particularly preferred embodiment of the present invention provides that a catch is arranged on the hook shaft, which takes the thread catcher lever along in an interlocked manner over at least a partial distance during the pivoting-in movement when the latter is disengaged. The interlocked take-along movement, which can be provided, for example, by at least one toothed cam on the hook shaft, which acts together with teeth on the thread catcher lever, permits an interlocked taking along in addition to the frictionally connected pivoting-in of the thread catcher lever by means of a spring, so that the actual performance of a cutting process following the triggering of the arresting means is assured. Otherwise it would be possible under unfavorable circumstances, for example if using an unsuitable thread, which is caught between the cutter and the thread catcher and therefore blocks the thread catcher lever, that a delayed, uncontrolled pivoting-in movement of the thread catcher lever occurs, wherein the latter can no longer meet the thread loop, for example.

To prevent the thread, which has already been grasped by the thread catcher lever in the course of the movement of the thread catcher to upper dead center and the subsequent sliding out of the hook path, from jumping out of the eye of the thread catcher lever, it is provided in a preferred further development of the invention that the control cam of the surface cam has a holding area which, prior to the cutting of the thread, moves the thread catcher into a position in which the lateral entry opening of the eye for receiving a thread is covered by a stationary element, for example the cutter.

To obtain a sufficient length of the needle thread for re-sewing after cutting, it is provided in a further preferred embodiment of the invention that a holding edge in the area of the entry opening of the thread eye and a pressure edge at the front end of the thread eye for pressing the thread against the cutter are placed at a defined distance from each other wherein, as a further measure, the thread eye is designed as an elongated hole and is divided by a transverse strip forming the holding edge, which has a longitudinal slit for receiving the thread. By means of this it is possible without problems to achieve the required length of the needle thread of approximately 25 to 30 mm without additional means, such as a thread puller or the like. It is further practical to design the control cam of the surface cam in such a way that the severing of the thread only takes place shortly before upper dead center of the thread catcher lever has been reached.

A further preferred design of the invention relates to the thread tension which prior to the cutting process can preferably be set to zero, for example by triggering the electromagnet for disengaging the thread catcher lever simultaneously with the triggering of a step motor for reducing the thread tension. The reduction of the thread tension prior to severing the thread prevents that, following severing, the thread slides out of the needle eye under its inherent tension and must again be threaded in a cumbersome way.

An exemplary embodiment of the invention will be discussed in detail in what follows by means of the attached drawings.

DETAILED DESCRIPTION OF THE PREFERRED EMBODIMENT

Figure 1:
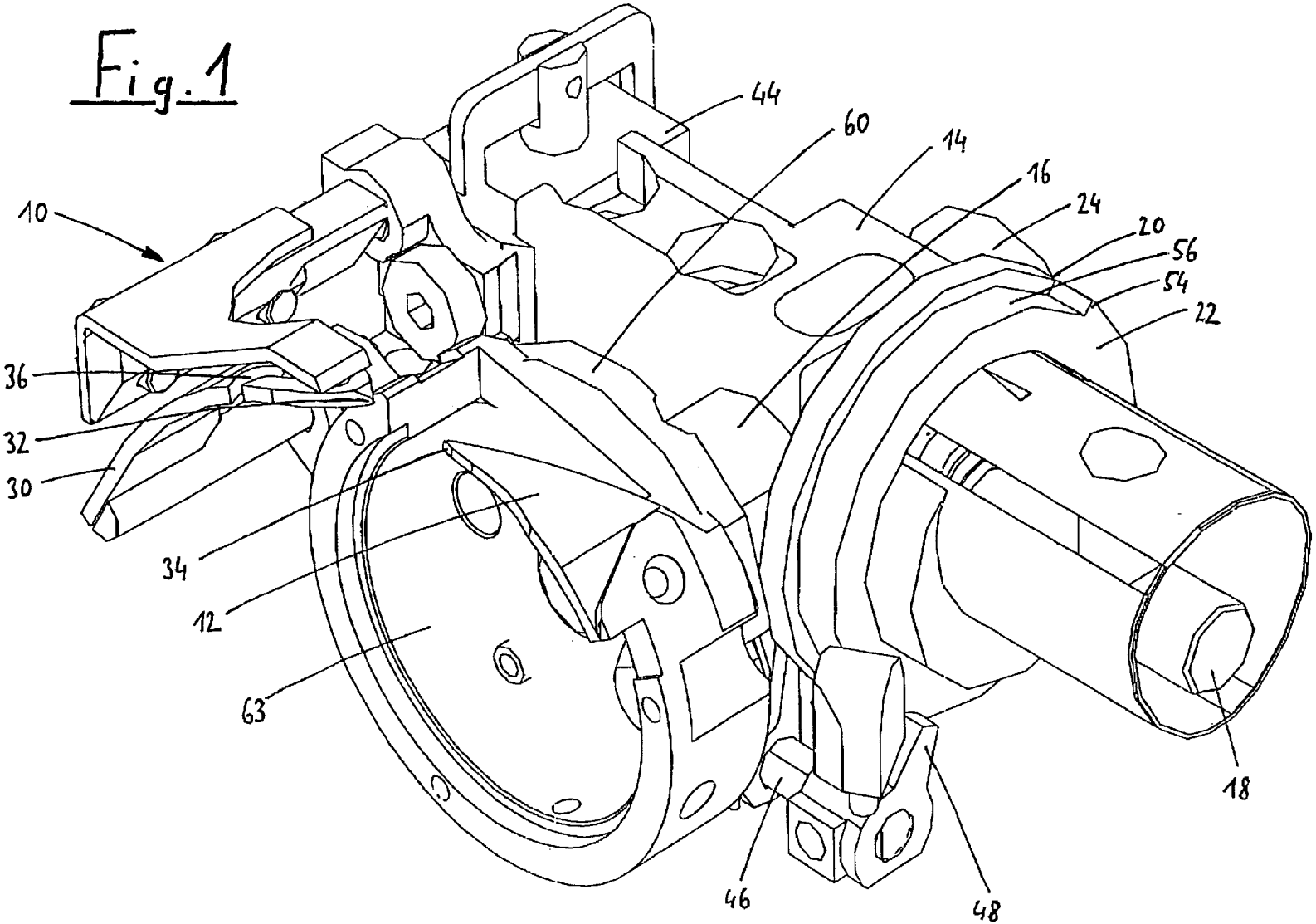
FIG. 1 is a schematic oblique view of a preassembled unit of the hook and the thread cutter.

A thread cutter 10 is represented in FIG. 1, which is embodied as a preassembled unit together with a rotating hook 12 of a sewing machine. Here, a hook shaft 16 with the hook 12 arranged in a torque-proof manner thereon, as well as a main shaft 18, arranged at right angles to the hook shaft 16 for a connection with the drive mechanism of the sewing machine, are seated in a hook frame 14. The power transfer between the main shaft 18 and the hook shaft 16 is provided via a bevel wheel stage 20, wherein the driving first bevel wheel 22 of the main shaft 18 has twice the number of teeth as the driven second bevel wheel 24 of the hook shaft, i.e. the hook shaft rotates at twice the number of revolutions of the main shaft 18.

A thread catcher lever 26 is moreover pivotably seated on the hook frame (see FIG. 2), which is biased in a pivoting direction toward the hook shaft 16 by means of a torsion spring 28. A thread catcher 30 is arranged on the thread catcher lever 26, whose tip 32 is flush in the circumferential direction with the tip 34 of the hook 12 (also see FIG. 4). The thread catcher 30 has a thread eye 36 for receiving the thread, whose exact shape will be discussed at a later time.

During normal sewing the thread catcher lever 26 is maintained in a radially outer position by a detent element 38, which works together with a corresponding detent protrusion (not visible) on the thread catcher lever 26. A tension spring 40 here biases the detent element 38 in the direction of its blocking position. The detent element 38 is provided with an unlocking lever 42, which can be moved by an electromagnet 44, also attached to the hook frame 14, in such a way that the detent element 38 is pivoted into a position in which it releases the thread catcher lever 26.

An additional bolt 46 is furthermore provided, which is connected with a cam follower 48 acting as a stop and has teeth 50, which are in engagement with a circumferential tooth arrangement 52 on the thread catcher lever 26. The additional bolt 46 is guided, linearly displaceable, on the hook frame 14.

The cam follower 48 acts together with a cam front face 54 extending on the main shaft over approximately 180 degree in the area of the first bevel wheel 22. A cutout 56 of the front cam, which correspondingly extends over the remainder of the circumference, permits an axial displacement of the cam follower 48 only during the one revolution of the hook 12 during which the needle of the sewing machine cannot collide with the thread catcher 36. If displacement becomes possible and the detent element 38 is unlocked, the additional bolt 46 is taken along by the circumferential tooth arrangement 52 of the thread catcher lever 26 via the teeth 50 by means of the action of the torsion spring 28.

Following the unlocking of the thread catcher lever 26 by unblocking the detent element 38 and with the additional bolt 46 released, because of the pivot movement of the thread catcher lever 26 a pin-shaped cam follower 58 attached to the thread catcher lever 36 comes into contact with a surface cam 60 and follows a control cam 62 of said surface cam 60 during the subsequent revolution of the hook 12. The surface cam 60 is seated in a space-saving manner directly on the hook shaft at the rear of the hook body 63 for receiving the thread roll of the underthread.

Figure 3:
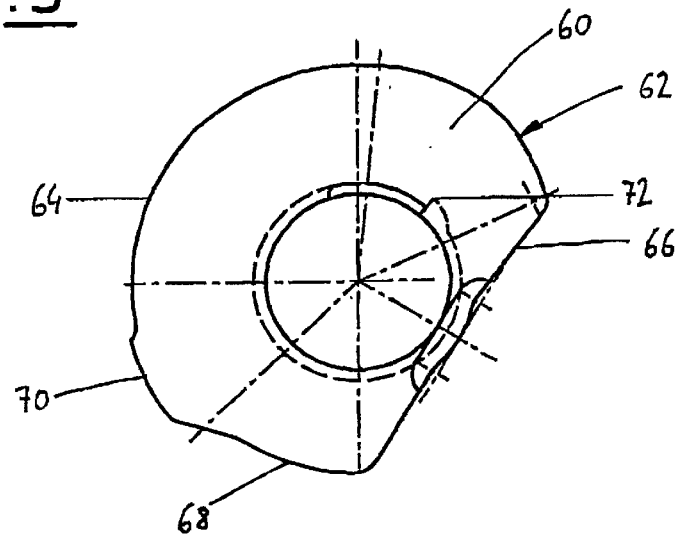
FIG. 3 is a plan view of the control cam of the surface cam of the unit in FIG. 1.

The shape of the control cam 62 is shown in greater detail in FIG. 3. The direction of rotation during the operation takes place in a counterclockwise direction in the view of the representation. The control cam 62 is divided into a first section 64 extending at a constant radius over approximately 180 degree, a following second section 66 with a radius which is greatly reduced and then increased again, a following third section 68 of a smaller radius than the first section 64, and a final fourth section 70, which has the largest radius and is capable of displacing the thread catcher lever 26 via the cam follower 58 into a position in which the detent element 38 again locks the cam followers 58 by snapping in.

Further, a toothed cam 72 is shown in FIG. 3, which is provided directly next to the surface cam 60 and which, when the cam follower is in contact with the first section 64, comes into engagement with a toothed cam (not visible) provided on the thread catcher lever 26, when the second section 66 has been reached and, aiding the torsion spring 28, interlockingly takes along the thread catcher lever in the pivoting-in direction over at least a portion of the area of the first half of the second section 66 with decreasing radius. In this case the two toothed cams are designed in such a way that they cannot come into engagement with each other when the thread catcher lever 26 is locked.

Figure 4:
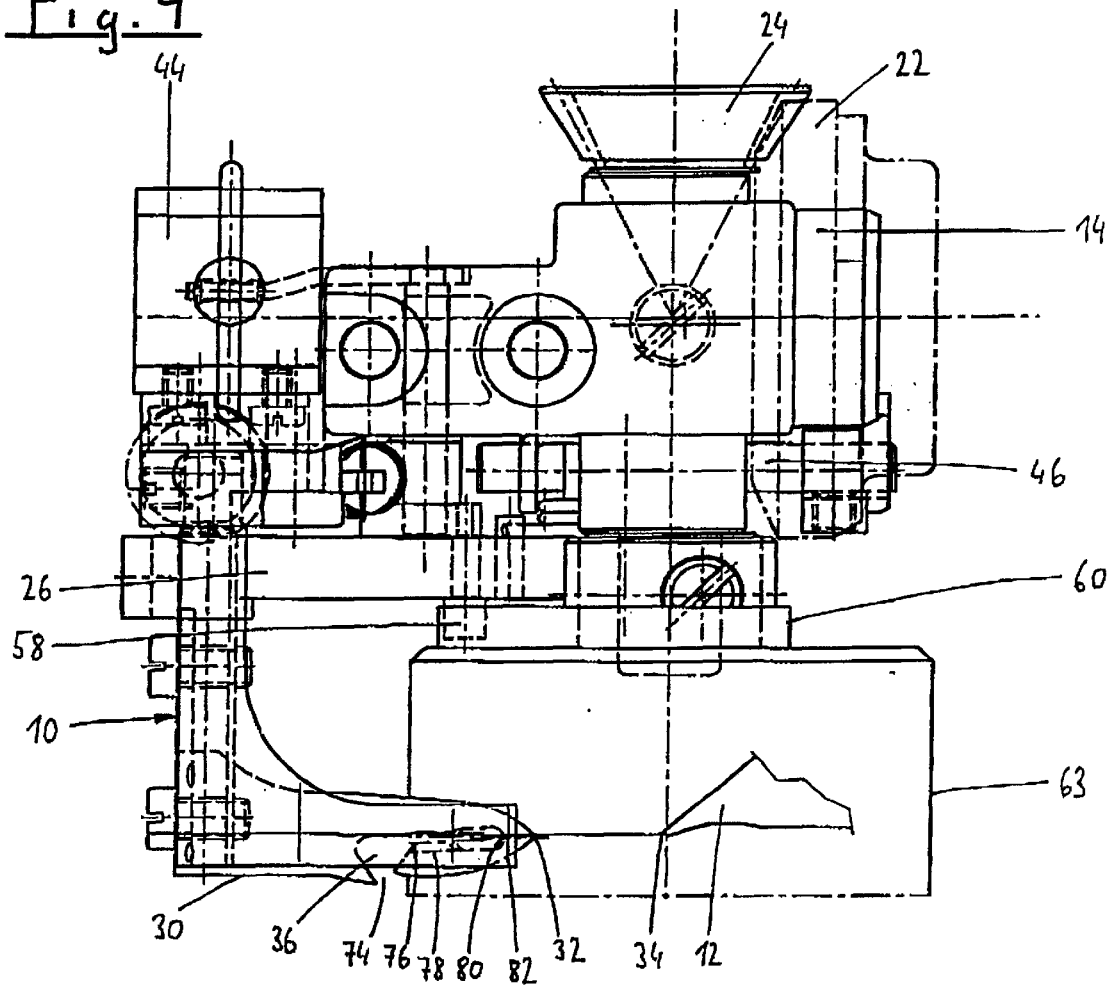
FIG. 4 is a view from above on the unit in FIG. 1 without the bevel wheel of the main shaft.

The design of the thread eye 36 of the thread catcher 30 can be seen in detail in FIG. 4. The thread eye 36 has a shape like an elongated hole with a lateral entry opening for the thread at the end remote from the tip 32. The eye 36 has a transverse strip 76 approximately in the center, on whose top surface a thread slit 78 is formed, so that severing of the thread only takes place when the end 80 facing the tip 32 and designed as a pressure edge pushes the thread against a cutter 82 attached in a fixed manner to the hook frame 14. The spatially distant position of the cutting edge from the needle penetrating point, together with the distance between the transverse strip 76 and the pressure end 80 of the eye, assures that a sufficient length of thread is provided for re-sewing after the cutting.

The cutting process is triggered manually or program-controlled, wherein program-control can mean, for example, that the thread cutter is automatically switched in by the electronic control device after defined sewing operations in order to sever the sewing threads at the end of the sewing process.

With manual actuation the machine is initially started at a reduced number of positioning revolutions of, for example, 60 rpm. Shortly after the thread loop has been picked up by the hook 12, the electromagnet 44 is charged and releases the thread catcher lever 26 via the unlocked detent element 38, so that the cam follower 58 can come into contact with the first section 64 of the control cam 62. As already mentioned, the additional bolt 46 is released and cannot block the thread catcher lever 26.

After the hook 12 has continued the turn by approximately 180 degree, wherein the thread triangle is optimally widenend, the toothed cam 72 comes into engagement with the associated toothed cam of the thread catcher lever 26, and the second section 66 allows the pivoting of the thread catcher 30 into the thread triangle, so that the thread can get into the thread eye 36. At the latest when the thread catcher lever 26 has reached the reversing point, i.e. has reached the point at the second section 66 with the smallest radius, the toothed cams 72 get out of engagement, so that the thread catcher 30 is moved by the control cam into an intermediate position in which the cam follower 48 rests against the third section 68 of the control cam 62. In this position, approximately 30 degree before the thread leaves the hook path, the cutter 82 covers the rear area of the thread eye 36 with the entry opening 74, wherein the thread slit 78 prevents the severing of the thread already in this position.

Prior to this and simultaneously with the triggering of the electromagnet 44, for example by means of a step motor setting, the thread tension has been reduced to zero, so that a sufficient length of thread for subsequent re-sewing is provided by the return movement of the thread catcher 30 and the upward movement of the thread catcher lever in the upper arm of the sewing machine. Thereafter, the thread leaves the hook path, wherein it cannot jump out of the eye 36 because of the covered entry opening 74.

Finally, the cam follower 59 moves into the fourth section 70 of the control cam 62, so that the pressure edge of the end 80 of the thread eye 36 severs the thread at the cutter 82. At the same time the thread catcher lever 26 is locked together with the detent element 38 and, after the thread catcher lever has reached top dead center in the upper arm of the machine, the machine is stopped. In the meantime the thread-tensioning step motor again operates at the set voltage value, so that the sewing machine is prepared for a subsequent sewing operation.

The reduction of the thread tension preferably to zero mainly has the purpose of preventing the thread from slipping out of the needle eye during the cutting of the thread because of its inherent tension. Therefore the thread tension must be zero no later than the time of cutting, however, the drawing off of the thread during the pivot movement of the thread catcher 30 is made easier when the thread tension is already reduced prior to the severing of the thread, so that a reduction even at the time of triggering the electromagnet 44 is also practical.

Figure 2:
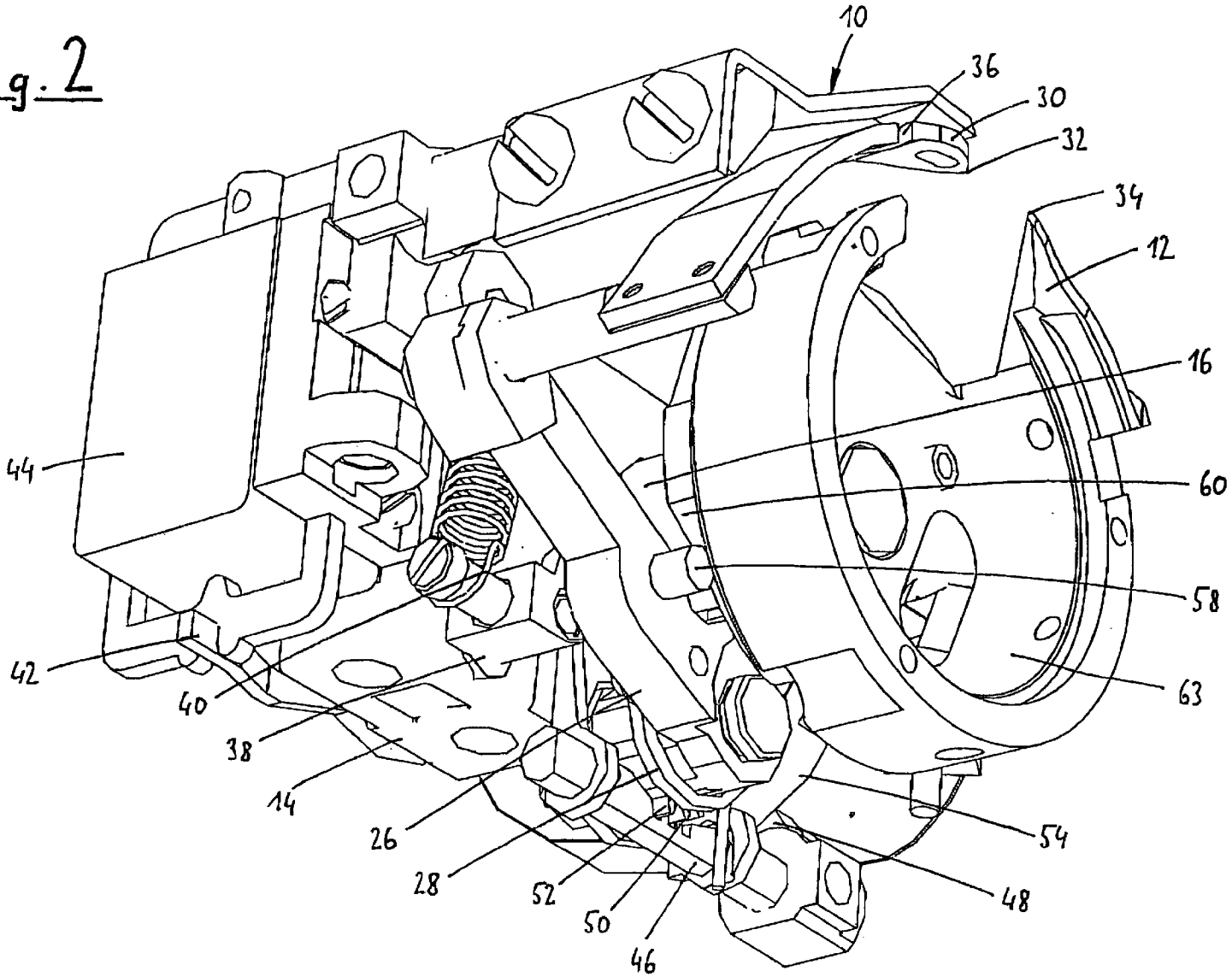
FIG. 2 is an oblique view from above on the unit in FIG. 1.

The unit of the hook and thread cutter shown in FIGS. 1 and 2 can be preassembled as a whole and adjusted, and during final assembly of the sewing machine only needs to be fastened on the body of the latter and connected with the main shaft 18. In this case the arrangement of all elements of the thread cutter on the hook frame 14 assures a particularly space-saving construction, which makes its housing in the lower free arm of the sewing machine easier.

What is claimed is:

1. A thread cutter for a sewing machine with a rotating hook (12), wherein a surface cam (60) is provided which, together with a cam follower (58), controls the movement path of a pivotable thread catcher lever (26), which grasps the thread with a thread catcher (30, 36) and severs it with a cutter (82), characterized in that the surface cam (60) is connected in a torsion-proof manner with the hook (12), and that arresting means (38) are provided which, in their blocking position, maintain the cam follower (58), which is coupled with the thread catcher lever (26), radially outside the engagement range of the surface cam (60) and, with manual or program-controlled triggering, only release the cam follower (58) for contact with the surface cam (60) during one revolution of the hook, during which the needle is outside of the pivot range of the thread catcher (30).

2. The thread cutter in accordance with claim 1, characterized in that the cam follower (58) is arranged directly on the thread catcher lever (26), and/or the surface cam (60) axially directly next to the hook (12).

3. The thread cutter in accordance with claim 1, characterized in that the arresting means have a movable detent element (38), which in the blocking position maintains the thread catcher lever (26), which is pre-biased by a spring (28) in the direction of pivoting in, in a radial outer position in which the surface cam (60) and the cam follower (58) are out of engagement.

4. The thread cutter in accordance with claim 3, characterized in that the detent element (38) is releasable against the force of a restoring spring (40) with the aid of an electromagnet (44), so that the cam follower (58) of the thread catcher lever comes to rest against the surface cam 60) because of the force of the spring (28).

5. The thread cutter in accordance with claim 3, characterized in that a control cam (62) of the surface cam (60) has a cam section (70), which has the greatest radius of the control cam (62) and with the aid of which the thread catcher lever (26) can be conveyed into the blocking position in which it is locked together with the detent element (38).

6. The thread cutter in accordance with claim 1, characterized in that the arresting means have an additional bolt (46) which arrests the thread catcher lever (26) in the radially outward position during the revolution of the hook shaft (16), during which the needle moves downward into the engagement range of the thread catcher lever (30).

7. The thread cutter in accordance with claim 6, characterized in that the additional bolt (46) is coupled with a cam follower (48), which acts together with a cam (54, 56) which essentially extends over 180 degree on the main shaft (18) in the base of the sewing machine.

8. The thread cutter in accordance with claim 7, characterized in that the cam (54, 56) provided on the main shaft (18) is designed as an axial cam, and the cam follower (48) is coupled with a toothed rack (46, 50) as the additional bolt, which is in contact with teeth (52) around the pivot shaft of a thread catcher lever (26).

9. The thread cutter in accordance with claim 1, characterized in that a catch (72) is arranged on a hook shaft (16), which takes the thread catcher lever (26) along in an interlocked manner over at least a partial distance during the pivoting-in movement when the latter is disengaged.

10. The thread cutter in accordance with claim 9, characterized in that at least one toothed cam (72) is provided on the hook shaft, which acts together with teeth on the thread catcher lever (26).

11. The thread cutter in accordance with one of the preceding claims, characterized in that the control cam (62) of the surface cam (60) has a holding area (68) which, prior to the cutting of the thread, moves the thread catcher (30) into a position in which the lateral entry opening (74) of a thread eye (36) for receiving the thread is covered by a stationary element, for example the cutter (82).

12. The thread cutter in accordance with claim 5, characterized in that the control cam (62) of the surface cam (60) has a holding area (68) which, prior to the cutting of the thread, moves the thread catcher (30) into a position in which the lateral entry opening (74) of a thread eye (36) for receiving the thread is covered by a stationary element, for example the cutter (82).

13. The thread cutter in accordance with claim 12, characterized in that the thread eye (36), designed as an elongated hole, is divided by a strip (76) forming the holding edge, which has a longitudinal slit (78) for receiving the thread on its side facing the cutter (82).

14. The thread cutter in accordance with claim 1, characterized in that the thread tension can be set to zero prior to severing the thread.

15. The thread cutter in accordance with claim 14, characterized in that triggering of an electromagnet (44) for disengaging the thread catcher lever (26) takes place simultaneously with the triggering of a step motor for reducing the thread tension.

16. The thread cutter in accordance with claim 5, characterized in that the control cam (62) of the surface cam is embodied in such a way that the severing of the thread only takes place shortly before upper dead center of the thread catcher has been reached.

17. The thread cutter in accordance with claim 9, characterized in that the thread catcher lever (26) is pivotably seated on a hook frame (14) for seating the hook shaft (16).

* * * * *

UNITED STATES PATENT AND TRADEMARK OFFICE

CERTIFICATE OF CORRECTION

PATENT NO. : 6,516,735 B2
DATED : February 11, 2003
INVENTOR(S) : Hintzen et al.

It is certified that error appears in the above-identified patent and that said Letters Patent is hereby corrected as shown below:

Column 8,
Line 1, please delete "one of the preceding claims" and insert -- claim 5 --.

Column 9,
Line 5, please delete as printed and insert the following:
-- The thread cutter in accordance with claim 11, characterized in that a holding edge in the area of the entry opening (74) of the thread eye (36) and a pressure edge at the front end (80) of the thread eye (36) for pressing the thread against the cutter (82) are placed at a defined distance from each other --.

Signed and Sealed this

First Day of March, 2005

JON W. DUDAS
*Director of the United States Patent and Trademark Office*